US006453495B1

(12) United States Patent
Meggers et al.

(10) Patent No.: US 6,453,495 B1
(45) Date of Patent: Sep. 24, 2002

(54) CLAMPING DEVICE FOR DECK PANELS WITH SUPPORT SADDLES

(75) Inventors: Dave A. Meggers, Topeka; Jerry D. Plunkett, Russell; Stephen R. Gill, Russell; Robert L. Hoback, Russell; Hugh S. Walker; Jon Held, both of Manhattan, all of KS (US)

(73) Assignee: Kansas Department of Transportation, Topeka, KS (US)

( * ) Notice: Subject to any disclaimer, the term of this patent is extended or adjusted under 35 U.S.C. 154(b) by 0 days.

(21) Appl. No.: 09/387,287

(22) Filed: Aug. 31, 1999

(51) Int. Cl.[7] ..... E01D 19/12; A47B 96/06; E04G 5/06

(52) U.S. Cl. ..... 14/73; 248/228.3; 248/231.21; 248/231.41

(58) Field of Search ..... 14/6, 14, 22, 73; 248/228.3, 228.5, 231.21, 231.41, 231.61; 52/81.3, 774

(56) References Cited

U.S. PATENT DOCUMENTS 3,756,568 A * 9/1973 Mocny et al. ..... 256/59
3,841,609 A * 10/1974 Smith ..... 256/59
3,881,698 A * 5/1975 Marsh ..... 256/59
3,938,619 A * 2/1976 Kurabayashi et al. ..... 182/113
3,995,833 A * 12/1976 McLaughlin et al. ..... 256/59
4,669,577 A * 6/1987 Werner ..... 182/113
5,112,015 A * 5/1992 Williams ..... 248/236
5,335,386 A * 8/1994 Newell ..... 14/74.5
5,457,840 A * 10/1995 Derechin ..... 14/73
6,151,743 A * 11/2000 Church et al. ..... 14/73
6,158,915 A * 12/2000 Kise ..... 403/309

* cited by examiner

*Primary Examiner*—Gary S. Hartmann
(74) *Attorney, Agent, or Firm*—Chase Law Firm, L.C.

(57) ABSTRACT

A clamping device for use with or without a support saddle includes upper and lower filler bars adapted to extend along the upper and lower surfaces of a tongue like connecting member on an upstream deck panel. A pair of clamping bars are operable by a pair of bolts which extend though the filler bars and tongue like member upon placement of the panel atop the underlying support beams. Upon tightening the bolt, the free ends of the clamping bars bear against the underside of the support beam with the bolt head urging the tongue like member against the top of the beam so as to mechanically connect the panel to the beam. A support saddle has a pair of sidewalls of a selected height to space the overlying deck panel from the support beam. The top wall of the support saddle may be inclined to cant the deck panel relative to the support beam.

14 Claims, 10 Drawing Sheets

CLAMPING DEVICE FOR DECK PANELS WITH SUPPORT SADDLES

BACKGROUND OF THE INVENTION

This invention pertains to an assembly for attaching bridge deck panels to underlying support beams and a support saddle which adjusts the spacing and/or inclination of a bridge deck panel relative to the support beams.

The use of fiber-reinforced polymer ("FRP") composite bridge deck panels for a bridge road surface has advanced bridge construction and rehabilitation. The planar FRP panels are not conducive for water run off. Also, the FRP deck panels should be aligned with the adjacent road surface upstream and downstream of the bridge. In new construction this alignment is accomplished by the predesigned placement of the underlying support beams. However, in bridge rehabilitation the previously fixed support beams have been fixed and can not be easily adjusted.

Heretofore, composite materials were poured onto the deck materials to provide a surface having the desired inclination for water run off and thickness for alignment of the panels with the road surface. Such an additional surface adds a dead load to the bridge, requires maintenance and defeats the efficiency of the FRP panels. Thus, the inclination and/or spacing of the deck panels relative to the underlying support beams presented problems which needed to be resolved.

Also desired is a positive mechanical connection of the FRP deck panels to the underlying support beams. Adhesives and/or bolts have been used to connect the panels to the support beams. However, such methods have raised questions of their efficacy over extended periods of time. The composite materials are subject to failure. The bolts may become loose, present stresses on the FRP panels and may ultimately fail to carry their design load.

In response thereto we have invented a support saddle which is positioned atop the existing support beam and supports the overlying deck panel at selected inclinations and/or displacements from the underlying support beam. The saddles of preselected inclinations and heights provide preselected displacements and/or inclinations of the FRP bridge deck panel relative to the underlying support beams. Thus, the FRP bridge deck panels may be uniformly constructed and subsequently aligned and inclined by the support saddles.

Furthermore, we have invented a clamp assembly which mechanically connects an FRP bridge deck panel to the underlying support beams with or without a support saddle therebetween.

The clamp assembly includes upper and lower filler bars designed to be positioned along the tongue like connecting member which protrudes from the mating edge of the leading/upstream deck panel. Bolts extend between these upper and lower filler bars and through the tongue like connector of the leading bridge panel. A pair of clamping bars present lower free ends which are adapted to bear on the underside of the top flange of the underlying I-beam. Upon tightening the associated bolts, the free ends of the clamping bar bear against the underside of the I-beam. The overlying connector member, positioned between the upper and lower bars, is drawn towards the I-beam. These actions secure the adjacent portion of the panel to the beam. A plurality of clamping devices are used at each I-beam/deck panel juncture.

It is therefore an object of this invention to provide a support saddle which spaces and/or inclines an overlying deck panel relative to an underlying support beam.

Another object of this invention is to provide a clamp assembly which mechanically connects the FRP deck panels to the underlying support beam with or without a support saddle therebetween.

A particular object of this invention is to provide a support saddle, as aforesaid, configured to resist transverse movement relative to the support beam.

Another particular object of this invention is to provide a support saddle, as aforesaid, which can be adhesively bonded and/or mechanically attached to the support beam.

A further object of this invention is to provide a support saddle, as aforesaid, which can be manufactured by known honeycomb or pultrusion methods, accommodates thermal expansion movement of the bridge structure, reduces wear on the bridge deck panels and the beam support points and resists bridge loads.

A further object of this invention is to provide a clamp assembly, as aforesaid, which connects the FRP deck panels to the underlying support beam.

Another object of this invention is to provide a clamp assembly, as aforesaid, which resists deck panel movement relative to the support beam.

A further object of this invention is to provide a clamp assembly, as aforesaid, which is simple to install from a position atop the support beams and deck panels.

Another particular object of this invention is to provide a clamp assembly, as aforesaid, which can be used with or without the aforesaid support saddles, inhibits lateral buckling of the support beams under heavy loads, allows for various thermal expansions of the deck panels and support beams and precludes FRP panel creep relative to the support beams.

Other objects and advantages of this invention will become apparent from the following description taken in connection with the accompanying drawings, wherein is set forth by way of illustration and example, embodiments of this invention.

BRIEF DESCRIPTION OF THE DRAWINGS

FIG. 7 illustrates sectional views of the complementary connecting members of the leading and trailing deck panels;

DESCRIPTION OF THE PREFERRED EMBODIMENT

Figure 1:
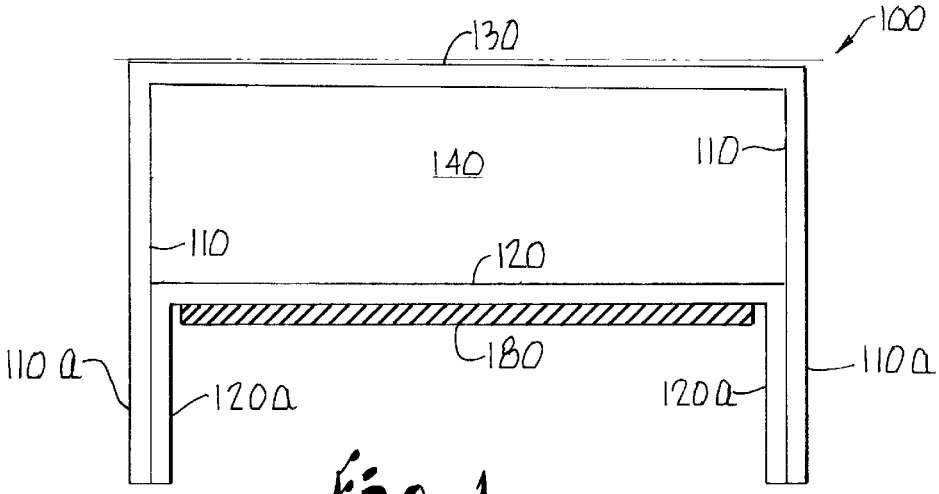
FIG. 1 is an end view of a support saddle with an underlying neoprene pad.

Turning more particularly to the drawings, FIG. 1 shows an end view of the saddle 100 comprising first and second spaced-apart sidewalls 110, a bottom wall 120 and top wall 130. End walls 140 may connect the sidewalls 110 at opposed ends thereof. The sidewalls 110 are spaced apart greater than the width of the top flange 1010 of the I-beam 1000 and have depending walls 110*a,* which extend below the top flange of the I-beam. Likewise the bottom wall 120 has depending walls 120*a* adjacent the sidewall extensions 110*a*. The saddle and core are made of a FRP material capable of supporting a deck panel (4000 lbs.) and the bridge traffic loads. A neoprene pad 180 positioned between the bottom wall 120 of the saddle and top flange 1010 of I-beam 1000, is also shown.

Figure 2:
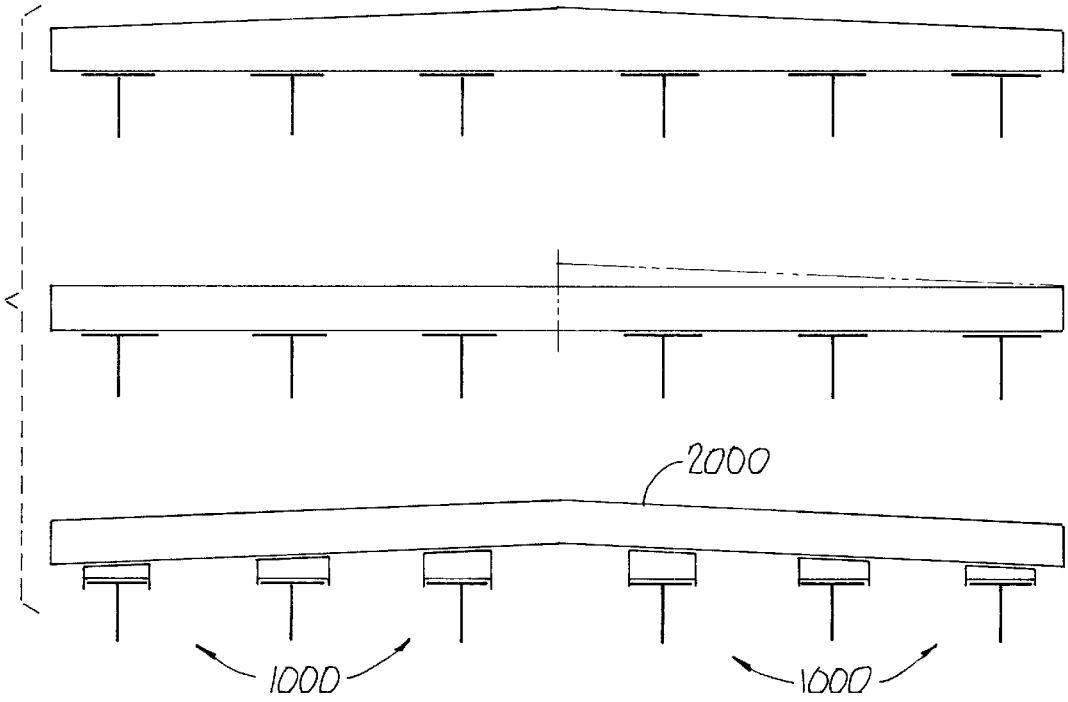
FIG. 2 diagrammatically shows prior decks and a plurality of saddles intermediate a plurality of underlying support beams and deck panel.
Figure 3:
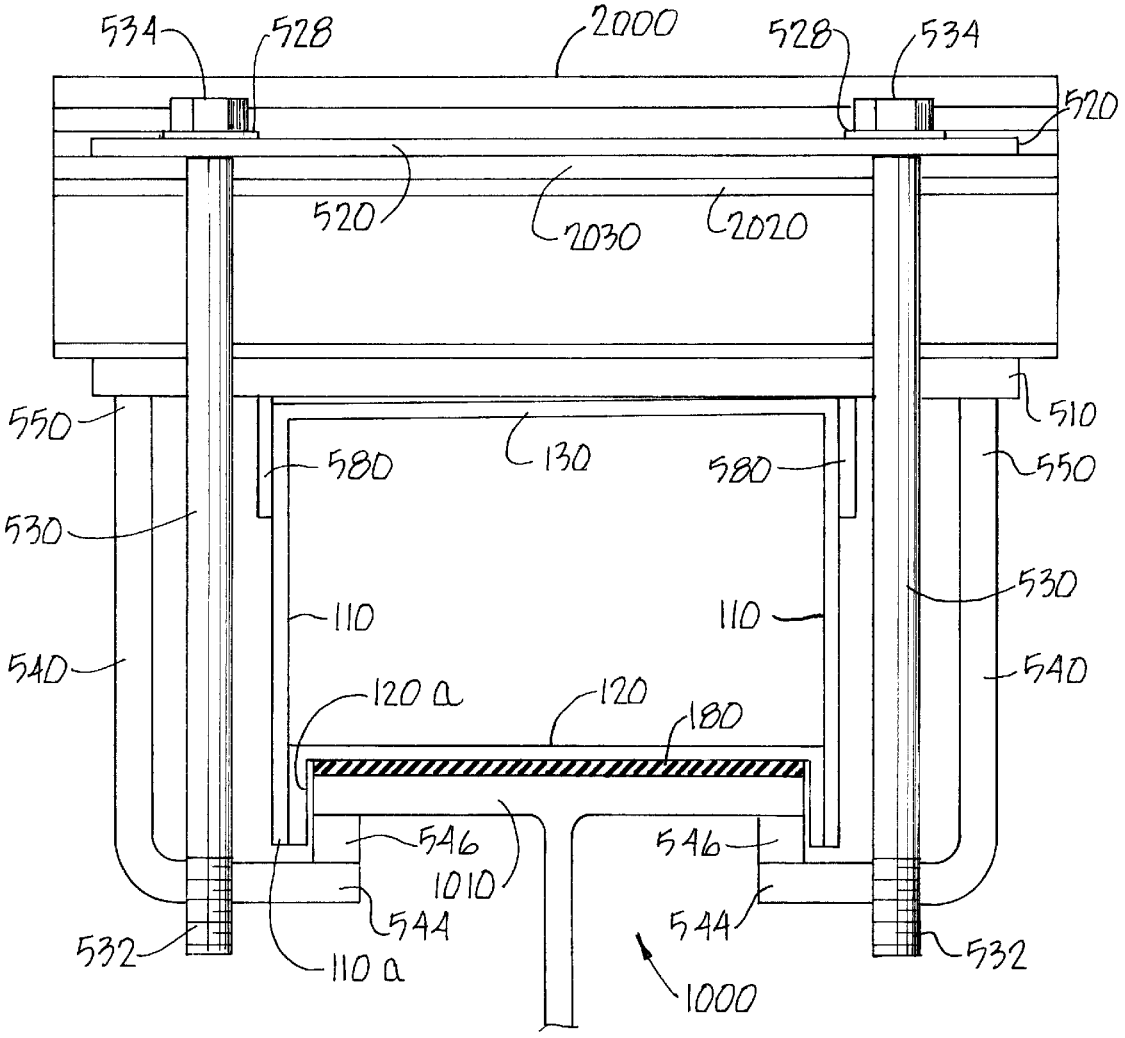
FIG. 3 is an elevation view along an I-beam illustrating a clamp assembly connecting an overlying upstream deck panel to the I-beam with a support saddle therebetween.
Figure 4:
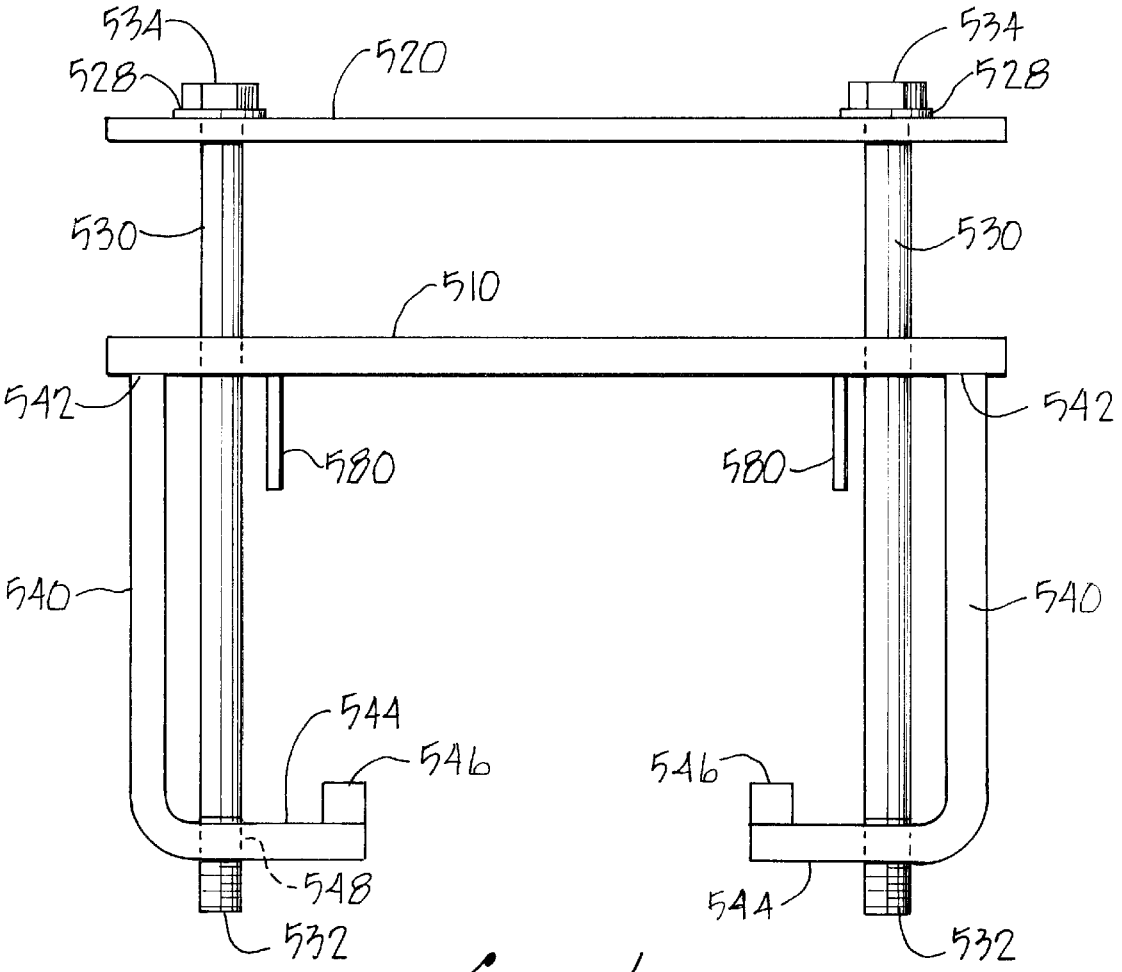
FIG. 4 is an elevation view of the clamp assembly of FIG. 3 removed from the I-beam.
Figure 5:
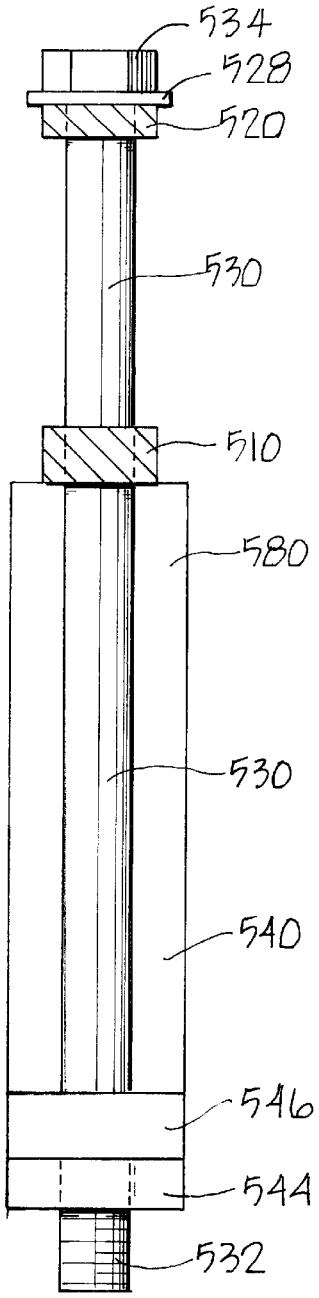
FIG. 5 is a side view of the bolt/clamping bar combination.
Figure 6:
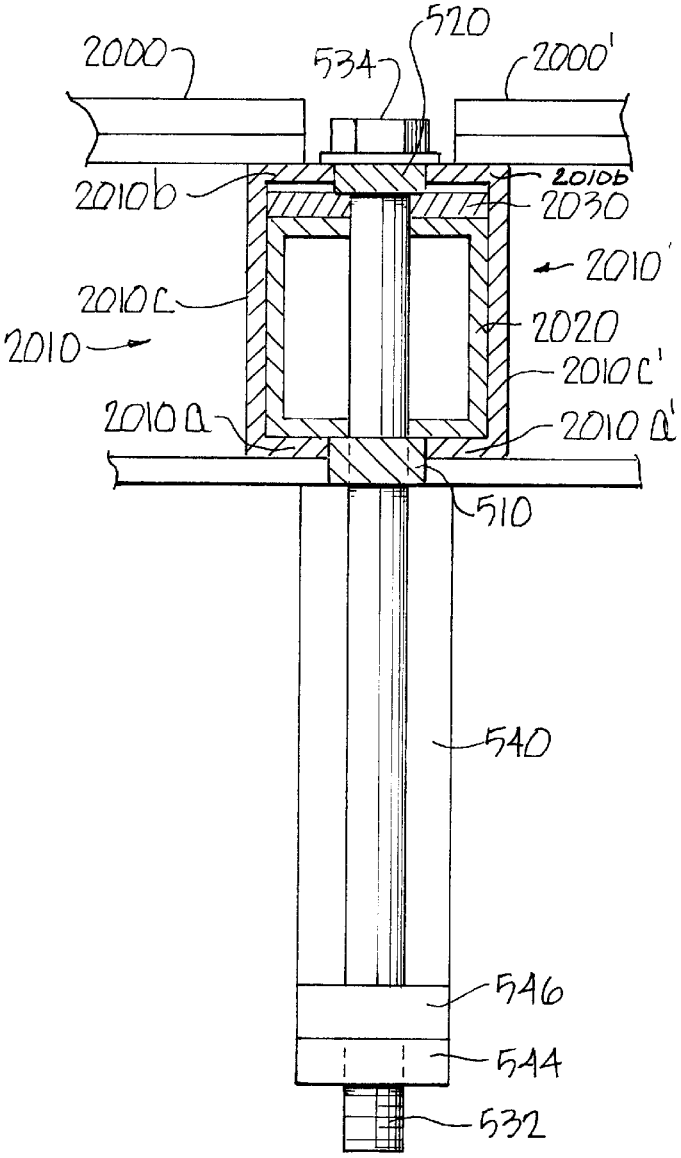
FIG. 6 is a side view of the clamp assembly of FIG. 3 with associated leading and trailing FRP deck panels.
Figure 1:
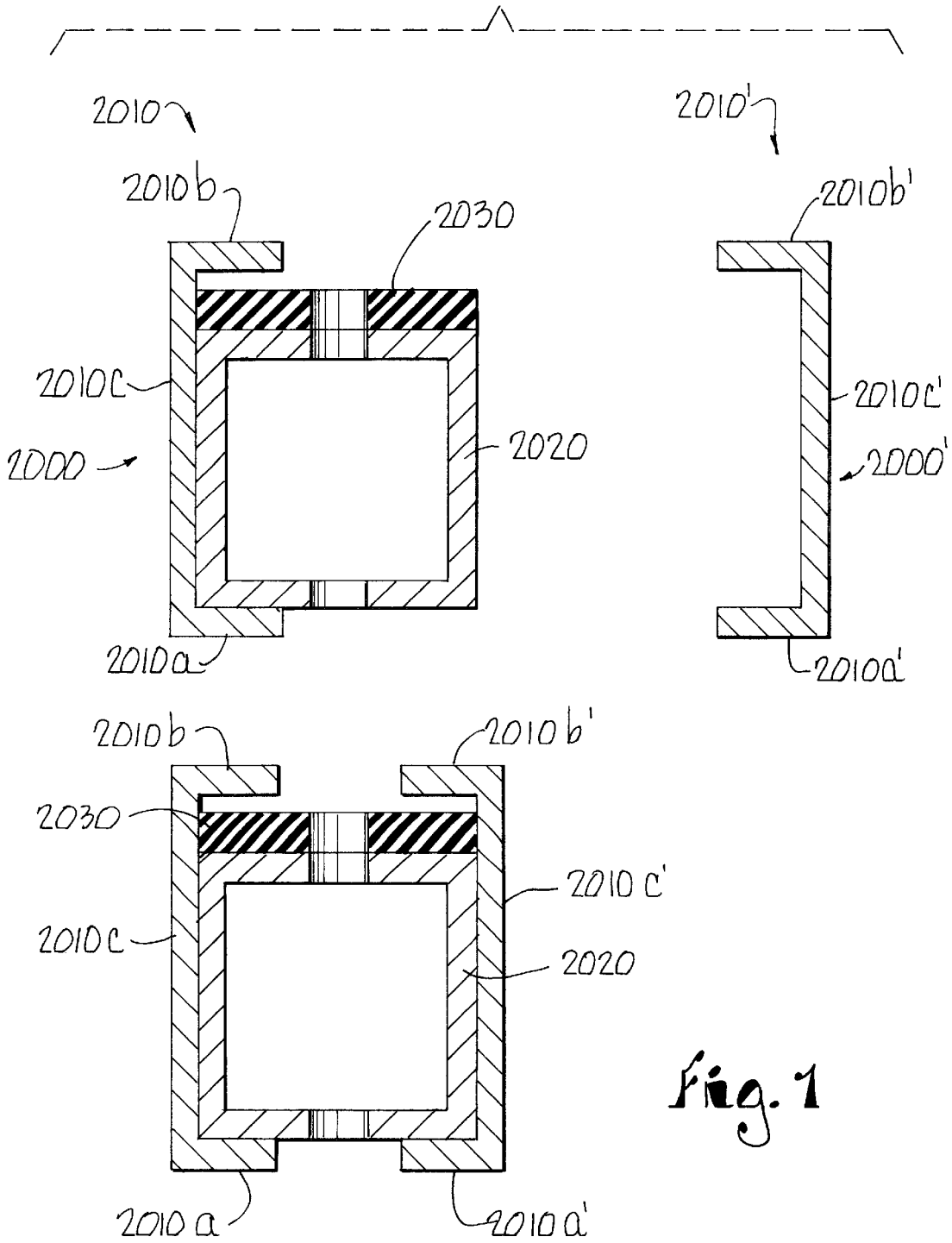
Figure 8:
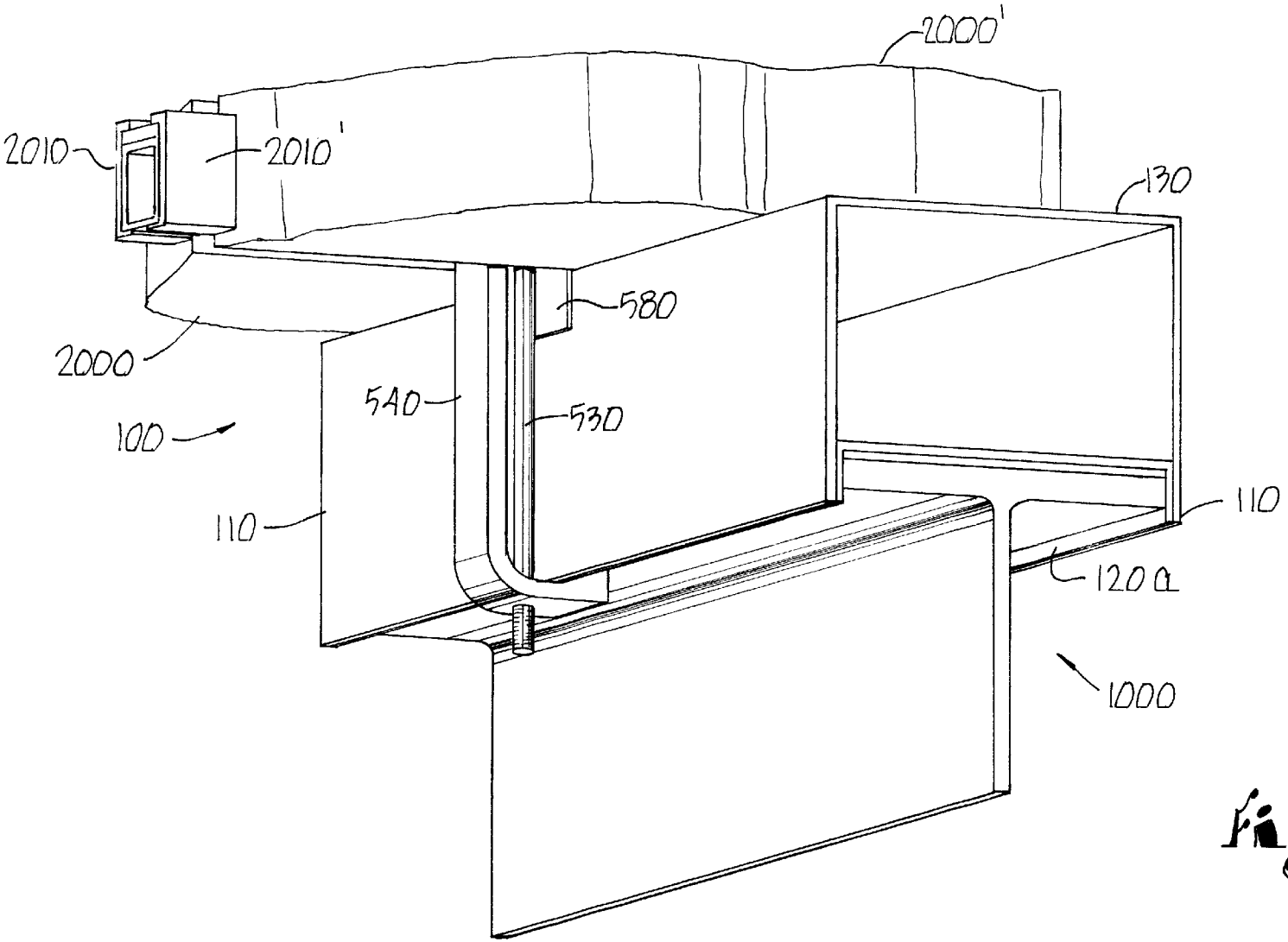
FIG. 8 is a perspective view illustrating fragmentary leading and trailing deck panels connected to an I-beam by a clamp assembly with portions of the underlying support saddle broken away to show the support structure therein.
Figure 9:
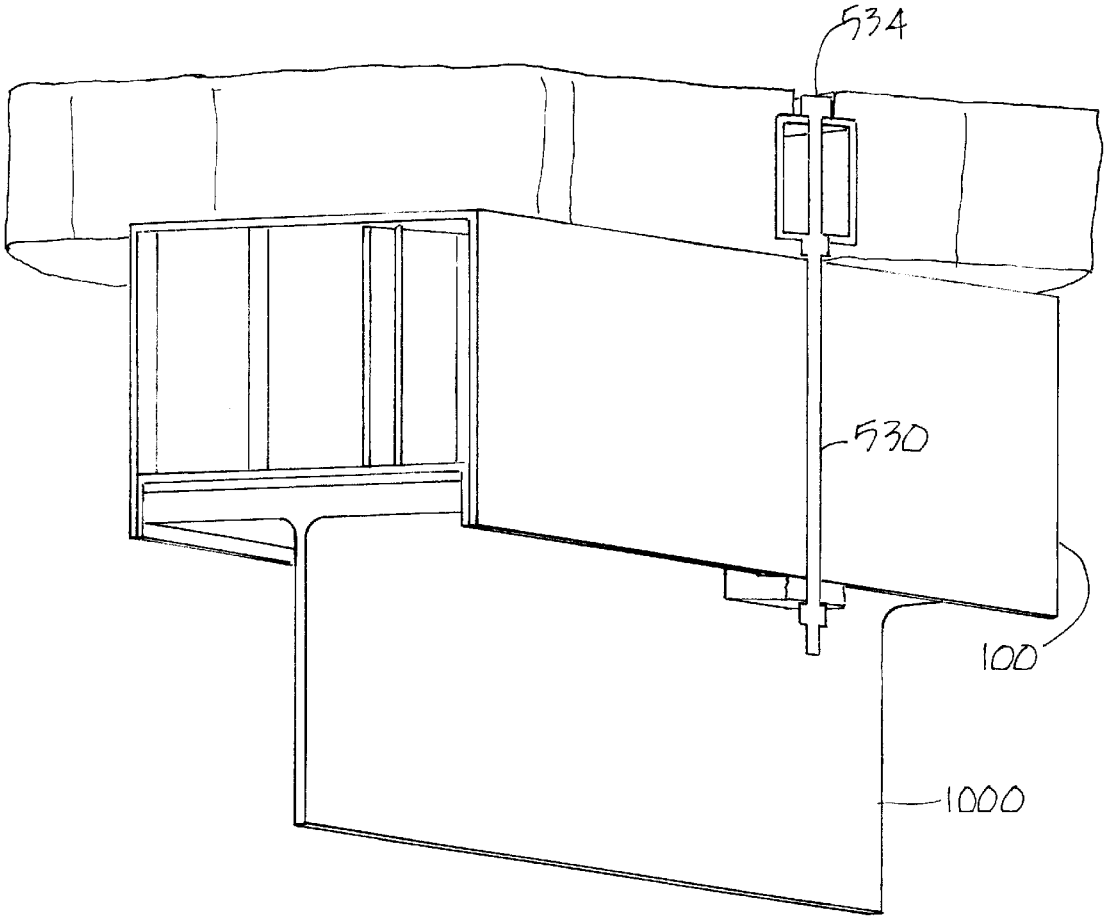
FIG. 9 is an opposed perspective view of the panels with connecting members broken away, a clamp assembly, a broken away support saddle and I-beam combination with a portion of the base of the clamping bar broken away to show the bolt extending therethrough.
Figure 10:
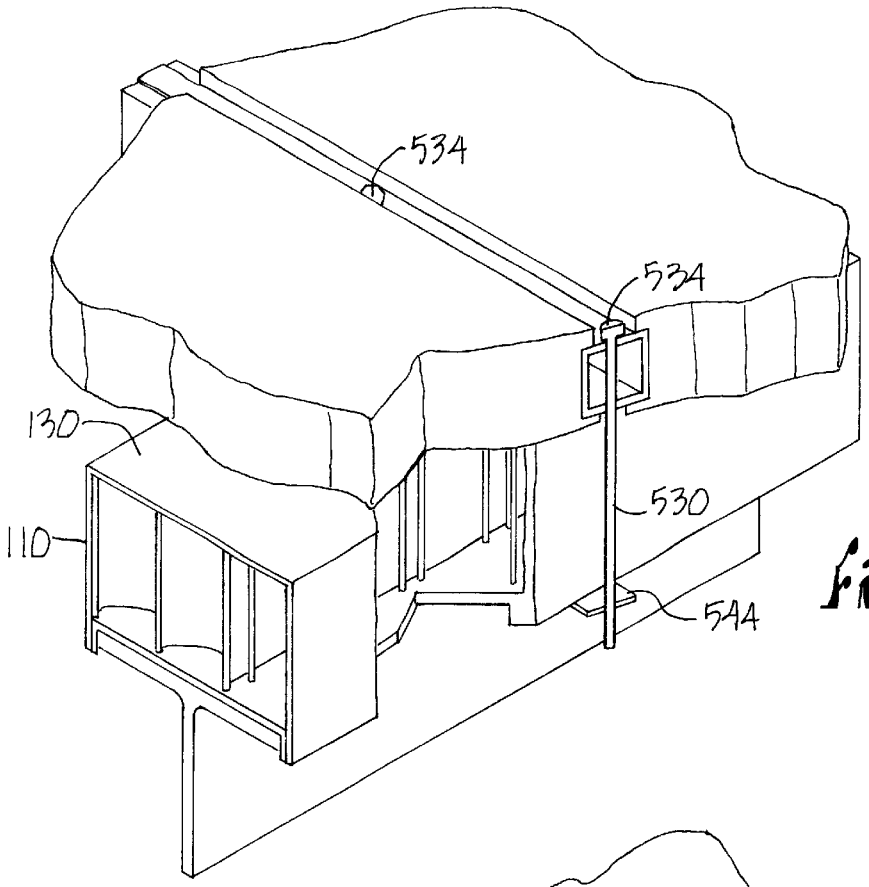
FIG. 10 is a top perspective view of the above FIG. 9 combination.
Figure 11:
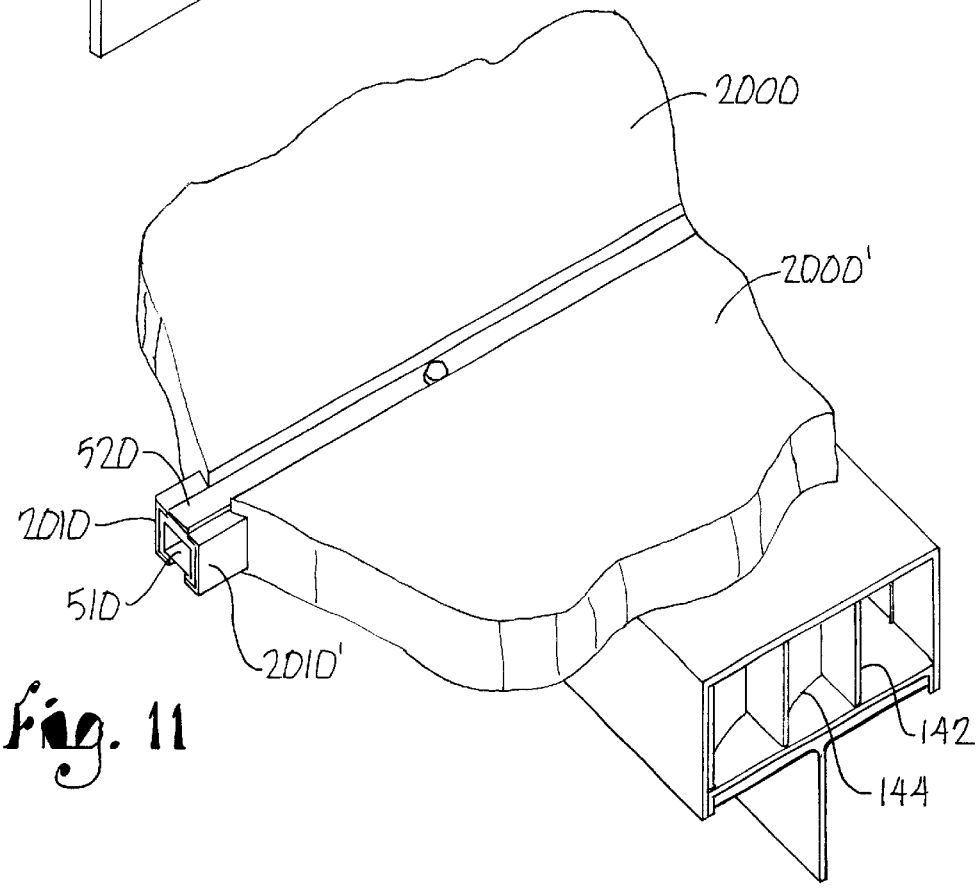
FIG. 11 is another top perspective view of the panels atop a broken away saddle with the connecting members extending beyond the broken away panels.
Figure 12:
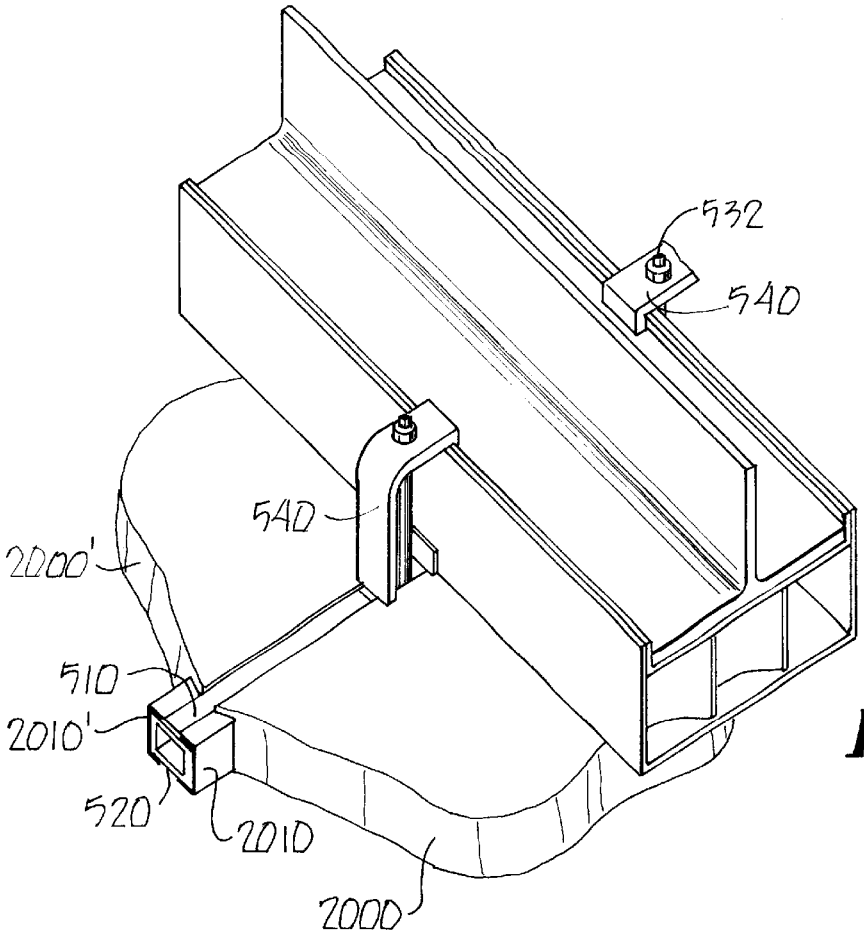
FIG. 12 is a bottom view of the above combination from the underside thereof.
Figure 13:
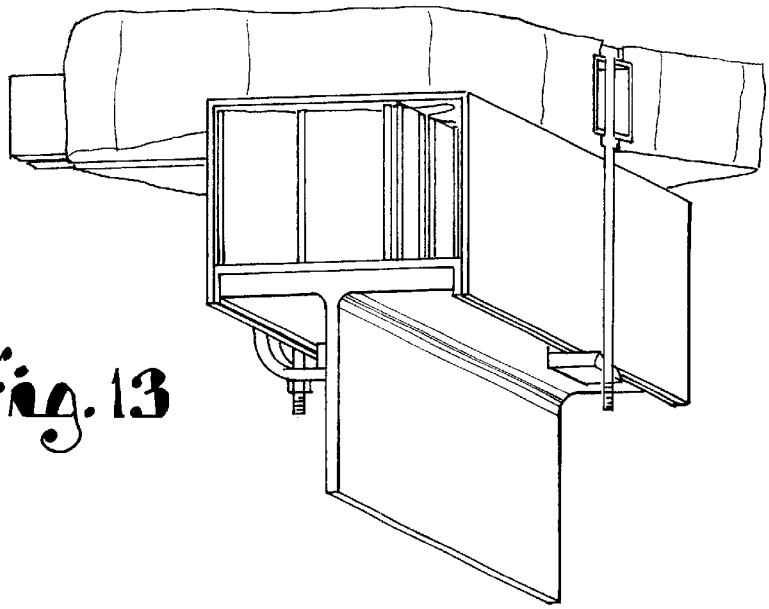
FIG. 13 is a front perspective view of the above combination.
Figure 14:
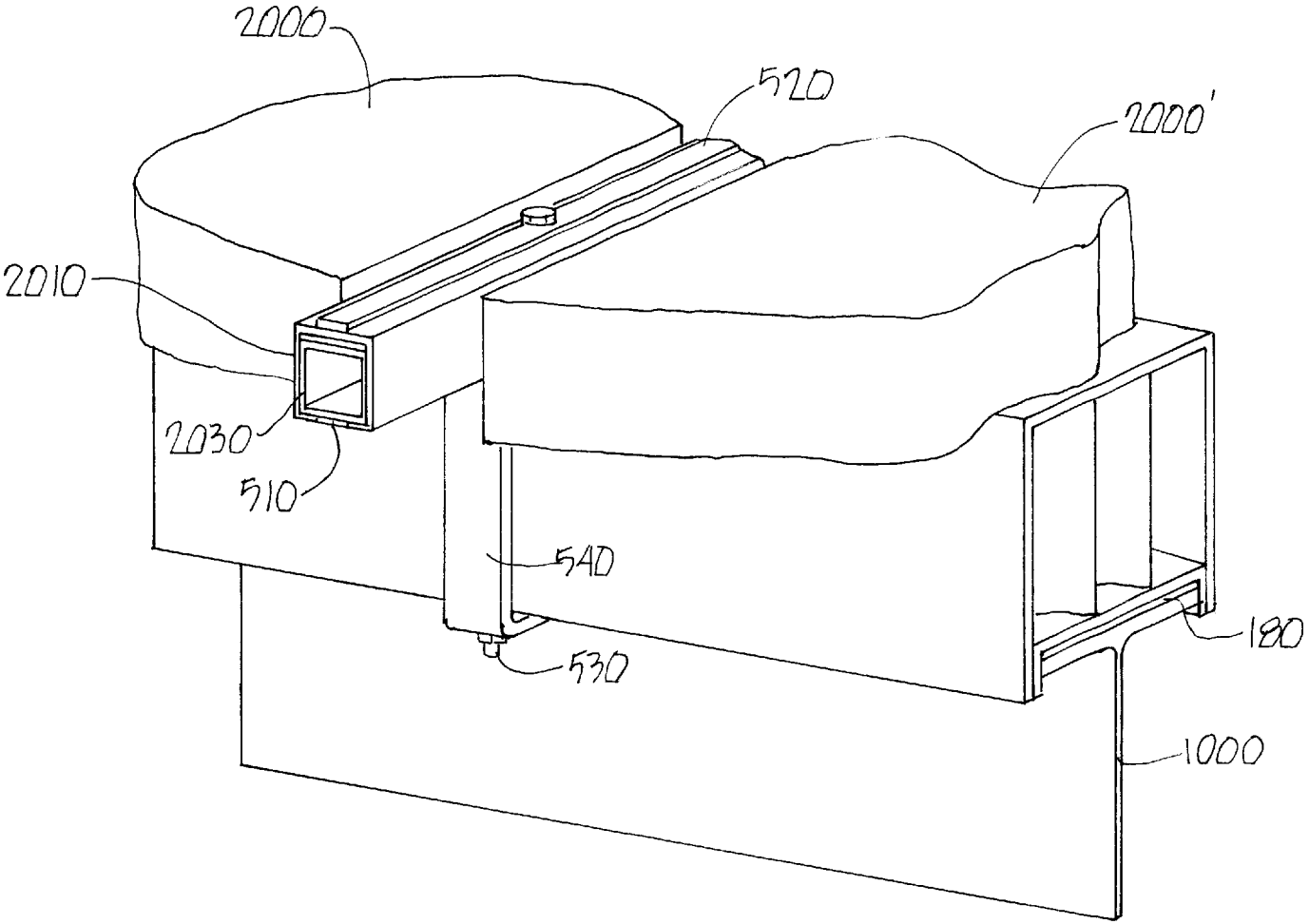
FIG. 14 is a side perspective view of the above combination.

The bottom wall 120 of the saddle 100 is adapted to be positioned atop the top flange 1010 of the I-beam 1000 with the sidewall 110*a,* 110*b* and bottom wall 120*a,* 120*b* extensions depending on both sides of the I-beam flange 1010 therefrom. These depending flanges 110*a,* 120*a* diminish lateral movement of the support saddle 100 relative to the top flange 1010 of the I-beam 1000. As diagrammatically shown in FIG. 2, a series of support addles are used along the plurality of the underlying support beams which underlie a deck panel 2000. The plurality of saddles 100 are of different heights and of a selected top wall inclination so that the spacing and/or inclination of the overlying deck panel relative to the underlying support beam 1000 can be achieved. The top wall 130 need not be angled but may be parallel to the bottom wall 120 if the saddle 100 is to space, but not incline, the overlying deck panel relative to the I-beam 1000.

The interior of the saddle preferably comprises a vertical honeycomb type of FRP support panels 142 similar in construction to a corrugated cardboard construction. The typical honeycomb cores are 2–4 mm thick and include flat and sinusoidal layers or panels. The sinusoidal layers have a 100 mm wavelength and 50 mm amplitude. The sinusoidal layer 144 is between the flat layers 142 of material. The material is FRP composite material but may be any suitable material which resists the weight of the bridge deck panel 2000 and bridge loads.

Accordingly, the sidewalls 110 of the saddle 100 are manufactured to vary the height of the top wall 130 from the bottom wall 120. Thus, the overlying deck panels 2000 are spaced at a preselected distance from the underlying support beams 1000 in order to align the deck panels 2000 with the bridge adjacent road surfaces. Also, during manufacture the top walls 130 of the saddles 100 may be inclined so that the overlying deck panel 2000 is inclined e.g. a 1.56% grade from the central crown, to provide for water run off. As shown, in FIG. 2 the height of the sidewalls 110 of the saddle 100 decreases as the saddles progress from the crown to the sides of the bridge. This combination of preselected saddle dimensions provide the desired inclination and/or spacing for alignment of the deck panels 2000 with the adjacent road surfaces.

Clamp assembly 500 mechanically connects an upstream panel 2000 to the underlying beams 1000. As shown in FIG. 7, the leading and trailing bridge deck panels 2000, 2000' have facing C-shaped channels 2010, 2010' along the opposing edges of each panel 2000, 2000'. The complementary C-shaped channel 2010 of the leading/upstream deck panel 2000 includes a square tube 2020/flat bar 2030 combination adhesively adhered to channel 2010 which functions as a tongue for a tongue/groove mating at the adjacent panels 2000, 2000'. Our clamp assembly 500 is designed to connect the leading deck panel 2000 to the underlying support beams 1000 prior to placing the C-shaped channel/groove 2010' of the downstream deck panel 2000' about the tongue/tube 2020. A sealer is placed about the tube 2020/channel 2010' interface to preclude water seepage therein. The tongue/tube 2020 thus presents a male like mating member designed to mate with the complementary female member presented by the downstream C-shaped channel 2010'. A plurality of clamp assemblies 500 are to be positioned along the male type connector of the upstream deck panel 2000.

Each clamp assembly 500 comprises a steel upper filler bar 520 (520 ⅜×1¼×15⁹⁄₁₆) and a lower filler bar 510 (⅝×1¼×15⁹⁄₁₆) with a pair of ⅝" bolts 530 extending therebetween. The bolts 530 present an upper head end 534 and a lower threaded end 532. A pair of J-shaped clamp bars 540 include a top end 550 against the underside of the lower filler bar 510 and a base 544 with foot 546 at the lower free end. The foot 546 is for bearing against the underside 1000 of the top flange 1010 of the I-beam 1000. A threaded aperture 548 in base 544 of each clamping bar 540 engages the threaded end 532 of the bolts 540 therein.

In use the leading deck panel 2000 is placed atop the underlying I-beams 1000 with or without the support saddle 100 therebetween. The tongue/tube 2020 with bar 2030 has been adhesively secured within the C-shaped channel 2010 of the panel 2000. The steel upper 520 and lower 510 filler bars are extended along the upper and lower surfaces of the tube 2020 adjacent the upper and lower free ends of the C-shaped channel 2010. Apertures have been pre-drilled in these upper 520 and lower 510 filler bars, bar 2030 and tube 2020 to allow for extension of the bolts 530 therethrough. The clamp bars 540 are then positioned on opposed sides of the beam 1000 with the top end 550 of each clamp bar 540 bearing against the underside of the lower filler bar 510 and the foot 546 adjacent the underside of the top flange 1010 of I-beam 1000. The bolts 530 are initially tightened by rotation of the head end 534 so as to initially maintain the ends 542, 546 of each clamp bar 540 in these positions. A clamp assembly 500 is so secured to every I-beam 1000/panel 2000 tongue 2020 juncture or as needed. Upon placing the downstream panel 2000' atop the I-beam 1000, the trailing panel is placed atop the support beams 1000 (with or without saddle 100) such that the reversed C-shaped channel/groove 2010' fits about the tongue/tube 2020 of upstream panel 2000. The free ends of the opposed channels 2010' bear against the filler bars 510. The head ends 534 of the bolts 530 are presented in the slot between the deck panels 2000, 2000'. The bolts 540 are further tightened to a preselected torque. Filler bars 510, 520 act as extended washers to disperse the forces therealong. Conventional washers 528 are also used. During such bolt 530 tightening the thread 532/aperture 548 engagement draws the foot 546 of each clamp bar 540 towards the underside of the I-beam 1000 flange 1010. Concurrently, bar 520 is drawn against tube 2020 and toward the top of the I-beam 1010 and filler bar 510. Filler bar 510 is not always needed. Accordingly, the tube 2020, as held between bar 510, 520, is urged towards the I-beam. Concurrently, forces are directed by the feet 546 of the clamp bars 540 onto the underside of the I-beam. These actions firmly clamp the tongue like connector 2020 of panel 2000 to the I-beam 1000. This procedure is repeated for the full plurality of the male connector of the FRP bridge deck panels. The plurality of FRP end panels are then compressed in a conventional manner by various known compression techniques, e.g. a cable come along extending along the panels. As such, the plurality of compressed panels are connected to the underlying I-beams by the clamp assemblies 500 as above described without interfering with the mating engagement of the adjacent bridge deck panels. Flanges 580 depend from the lower filler bar 510. These flanges 580 diminish lateral movement of the clamp assembly 500 relative to the underlying saddle 100 and/or support beam 1000.

The above described clamp assemblies are easily installed from atop the deck panels. Once in place, these devices 500 are exposed only on the underside of the bridge deck which protects the assemblies 500 from the elements and disassembly. The clamp assemblies 500 do not preclude the additional use of adhesive bonding and the above described support saddles if required.

It is to be understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A clamp assembly adapted for attaching a deck panel atop a support beam, the panel having an edge presenting a connecting member having top and bottom surfaces with a web spanning therebetween, said clamp assembly comprising:

an upper bar adapted to extend along the top surface of the connecting member;

a lower bar spaced from said upper bar and adapted to extend along the bottom surface of the connecting member, said bars adapted to traverse the underlying support beam;

a pair of bolts extending through opposed ends of said upper and lower bars, each bolt having an upper head end and a lower threadable end, said bolts extending between said upper and lower bars and the top and bottom surfaces of the connecting member positioned between said upper and lower bars;

a clamping bar operably attached to each bolt, each clamping bar having a first upper end bearing against said lower bar and a second lower end adapted for bearing against the support beam upon placement of the deck panel atop the support beam;

an aperture in said clamping bar for engagement of said threadable end of each bolt therewith, a rotation of each bolt head in a first direction urging said second lower end of said clamping bar against the support beam and the connecting member towards the support beam, thereby connecting the deck panel to the support beam.

2. A clamp assembly as claimed in claim 1, wherein the connecting member comprises a tube presenting the top and bottom surfaces, said upper bar extending along the top surface of the tube and said lower bar extending along the bottom surface of the tube, said bolts extending through the tube top and bottom surfaces.

3. A clamp assembly as claimed in claim 1, wherein said clamping bar further comprises:

a first segment including said upper end, said upper end bearing against said lower bar;

a base segment extending from said first segment and including said lower end, said aperture in said base segment;

a foot atop said lower end of said base segment, said foot adapted to bear against the support beam.

4. A clamp assembly as claimed in claim 3, wherein the support beam comprises an I-beam presenting a web with a top flange thereon, said foot adapted to bear against an underside of the top flange of the I-beam.

5. A clamp assembly as claimed in claim 1 further comprising a pair of flanges depending from said lower bar with the support beam therebetween, said flanges adapted to resist movement of said clamp assembly relative to the support beam.

6. A clamp assembly as claimed in claim 1 comprising a saddle interposed between the support beam and said lower bar, said saddle comprising:

a bottom wall adapted to lie atop the underlying support beam;

a pair of side walls of a preselected height upstanding from said bottom wall;

a top wall atop said side wall to be positioned adjacent said lower bar;

a support means within said saddle for resisting weight of the deck panel atop said top wall, said support saddle bottom wall adapted to be positioned atop the support beam with the top wall adapted to support the deck panel away from the support beam generally corresponding to said height of said saddle side walls.

7. A clamp assembly as claimed in claim 6 wherein said top wall of said saddle is inclined at a preselected inclination relative to the support beam thereby inclining the deck panel therein.

8. A clamp assembly as claimed in claim 7 wherein said top wall of said saddle is inclined at a preselected inclination relative to the support beam thereby inclining the deck panel thereon.

9. A clamp assembly for attaching a deck panel atop a support beam, the panel having an edge presenting a connecting member having top and bottom surfaces, said clamp assembly comprising:

an upper bar adapted to extend along the top surface of the connecting member;

a lower bar vertically spaced from said upper bar and adapted to extend along the bottom surface of the connecting member, said bars adapted to traverse the underlying support beam upon placement of the panel atop the support beam;

at least one bolt extending through said upper and lower bars, said at least one bolt having an upper head end and a lower threadable end, said at least one bolt extending through the top and bottom surfaces of the connecting member;

a clamping bar operably associated with each said at least one bolt, said clamping bar having a first end for bearing against said lower bar and a second lower end adapted for bearing against the support beam upon placement of the deck panel atop the support beam;

means associated with each said clamping bar for engaging said threadable end of said at least one bolt, whereby a rotation of said at least one bolt head in a first direction urges said second lower end of said clamping bar against the support beam and said bolt head end against said upper bar and towards said support beam, thereby clamping the deck panel to the support beam.

10. A clamp assembly as claimed in claim 9 comprising a saddle interposed between the support beam and said lower bar, said saddle comprising:

a bottom wall adapted to lie atop the underlying support beam;

a pair of side walls of a preselected height upstanding from said bottom wall;

a top wall atop said side walls to be positioned adjacent said lower bar;

a support means within said saddle for resisting weight of the deck panel atop said top wall, said support saddle bottom wall adapted to support the deck panel away from the support beam generally corresponding to said height of said saddle side walls.

11. a clamp assembly as claimed in claim 9 further comprising a pair of flanges depending from said lower bar with the support beam therebetween, said flanges adapted to diminish movement of said assembly relative to the support beam.

12. A clamp assembly as claimed in claim 9, wherein the connecting member presents a tongue like structure presenting the top and bottom surfaces, the connecting member adapted for engagement with a groove like connecting member of a downstream panel, said upper bar extends along the top surface of the tongue like member and said lower bar extending along the bottom surface of the tongue like member, whereby to clamp said tongue like member between the upper and lower bars.

13. A clamp assembly as claimed in claim 9, wherein said clamping bar comprises:

a first segment including said clamping bar first end;

a base segment extending from said first segment and including said second lower end, said engaging means in said base segment;

a foot at said second lower end of said base segment, said foot adapted to bear against the support beam upon said at least one bolt rotation.

14. A clamp assembly as claimed in claim 13, wherein the support beam comprises an I-beam presenting a web with a top flange thereon, said foot adapted to bear against an underside of the top flange of the I-beam.

* * * * *